US009581397B2

(12) United States Patent
Samuelson

(10) Patent No.: US 9,581,397 B2
(45) Date of Patent: Feb. 28, 2017

(54) HEAT EXCHANGER ASSEMBLY HAVING A DISTRIBUTOR TUBE RETAINER TAB

(71) Applicant: MAHLE International GmbH, Stuttgart (DE)

(72) Inventor: David E. Samuelson, Wheatfield, NY (US)

(73) Assignee: MAHLE International GmbH, Stuttgart (DE)

( * ) Notice: Subject to any disclaimer, the term of this patent is extended or adjusted under 35 U.S.C. 154(b) by 414 days.

(21) Appl. No.: 13/705,411

(22) Filed: Dec. 5, 2012

(65) Prior Publication Data

US 2013/0168070 A1 Jul. 4, 2013

Related U.S. Application Data

(60) Provisional application No. 61/581,180, filed on Dec. 29, 2011.

(51) Int. Cl.
*F28F 9/013* (2006.01)
*F28F 9/02* (2006.01)

(52) U.S. Cl.
CPC ..... *F28F 9/0131* (2013.01); *F28F 9/0273* (2013.01); *F28F 9/027* (2013.01); *F28F 9/0246* (2013.01)

(58) Field of Classification Search
CPC ..... F28F 9/027; F28F 9/0273; F28F 9/0246; F25B 39/028
USPC ..... 165/174, 178; 62/525
See application file for complete search history.

(56) References Cited

U.S. PATENT DOCUMENTS

| | | | | |
|---|---|---|---|---|
| 1,684,083 A | | 6/1927 | Bloom | |
| 2,097,602 A | | 11/1937 | Rohlin | |
| 2,759,248 A | | 8/1956 | Burgess | |
| 4,274,482 A | * | 6/1981 | Sonoda | 62/525 |
| 4,593,539 A | | 6/1986 | Humpolik | |
| 4,936,381 A | * | 6/1990 | Alley | 165/176 |
| 4,960,169 A | * | 10/1990 | Granetzke | F28F 9/0212 165/174 |
| 5,097,898 A | | 3/1992 | Verkaart | |

(Continued)

FOREIGN PATENT DOCUMENTS

CN 101858705 A * 10/2010 ..... F28F 9/0212

*Primary Examiner* — Leonard R Leo
(74) *Attorney, Agent, or Firm* — Brinks Gilson & Lione

(57) ABSTRACT

A heat exchanger assembly having an insertable distributor tube retainer tab configured to position and retain a distributor tube disposed within a first manifold extending along an axis $A_{manifold}$. The first manifold includes a manifold wall having an interior surface defining an interior chamber, an exterior surface opposite of the interior surface, and a retainer slot connecting the interior surface and the exterior surface. The retainer slot extends substantially transverse to the manifold axis $A_{manifold}$. The retainer tab is inserted through the retainer slot and includes a first tab portion disposed within the interior chamber and a second tab portion 104 engaged to the wall of the first manifold, and may also include a third tab portion engaged to a width surface of the retainer slot. The retainer tab includes a tab opening configured to engage and maintain the distributor tube within the predetermined position.

12 Claims, 4 Drawing Sheets

(56) References Cited

U.S. PATENT DOCUMENTS 5,125,454 A * 6/1992 Creamer ..... F28F 9/001 165/173
5,203,407 A 4/1993 Nagasaka
5,445,219 A 8/1995 Hutto et al.
5,505,254 A * 4/1996 Chiba ..... 165/178
5,651,268 A 7/1997 Aikawa
5,806,586 A 9/1998 Osthues
5,836,382 A 11/1998 Dingle et al.
5,896,754 A 4/1999 Balthazard et al.
6,145,587 A * 11/2000 Hanafusa ..... 165/174
6,161,616 A * 12/2000 Haussmann ..... B60H 1/3227 165/174
6,267,173 B1 7/2001 Hu et al.
6,289,980 B1 * 9/2001 Insalaco ..... F28F 9/0243 165/174
6,698,509 B2 * 3/2004 Rong ..... 165/174
6,796,374 B2 * 9/2004 Rong ..... 165/174
7,275,394 B2 10/2007 Lundberg
7,287,578 B2 10/2007 Ricci et al.
7,484,555 B2 2/2009 Beamer et al.
7,516,779 B1 * 4/2009 Marcus ..... F28D 7/106 165/174
7,549,466 B2 6/2009 Hayashi et al.
7,806,171 B2 10/2010 Taras et al.
7,946,036 B2 5/2011 Beamer et al.
2003/0010483 A1 1/2003 Ikezaki et al.
2004/0159121 A1 8/2004 Horiuchi et al.
2006/0102331 A1 5/2006 Taras et al.
2007/0062678 A1 3/2007 Hayashi et al.
2007/0256821 A1 11/2007 Mashiko et al.
2008/0023185 A1 1/2008 Beamer et al.
2009/0107171 A1 * 4/2009 Brodie et al. ..... 62/525
2009/0293535 A1 * 12/2009 Aung et al. ..... 62/515
2010/0089095 A1 4/2010 Macri et al.
2010/0089559 A1 4/2010 Gorbounov et al.
2011/0000255 A1 * 1/2011 Taras ..... F25B 39/028 165/173
2013/0160981 A1 * 6/2013 Wang ..... F28F 9/0212 165/178

* cited by examiner

HEAT EXCHANGER ASSEMBLY HAVING A DISTRIBUTOR TUBE RETAINER TAB

CROSS-REFERENCE TO RELATED APPLICATION

This application claims the benefit of U.S. Provisional Patent Application Ser. No. 61/581,180 for a DISTRIBUTOR TUBE RETAINER TAB, filed on Dec. 29, 2011, which is hereby incorporated by reference in its entirety.

TECHNICAL FIELD OF INVENTION

The present invention relates to a heat exchanger assembly having a distributor tube; more particularly, to a heat exchanger assembly having a distributor tube retainer tab configured to position and retain a distributor tube in a predetermined position.

BACKGROUND OF INVENTION

Air conditioning and heat pump systems for residential and commercial applications are known to employ modified automotive heat exchanger assemblies because of their high heat transfer efficiency, durability, and relatively ease of manufacturability. A typical automotive heat exchanger assembly includes an inlet manifold, an outlet manifold, and a plurality of extruded multi-port refrigerant tubes hydraulically connecting the inlet and outlet manifolds. The core of the heat exchanger assembly is defined by the plurality of refrigerant tubes and corrugated fins disposed between the refrigerant tubes for improved heat transfer efficiency and increased structural rigidity. For residential and commercial applications, the inlet and outlet manifolds typically extend horizontally while the refrigerant tubes extend vertically with respect to the direction of gravity.

The increased in scale of an automotive heat exchanger assembly for residential and commercial applications dramatically increases the lengths of the inlet and outlet manifolds, which may result in increased refrigerant mal-distribution through the core of the heat exchanger. For heat pump systems, in cooling mode the indoor heat exchanger assembly acts as an evaporator, and in heating mode the outdoor heat exchanger assembly acts as the evaporator. During operation in evaporative mode, a partially expanded two-phase refrigerant enters the lower portions of the refrigerant tubes from the inlet manifold, the lower manifold in evaporative mode, and expands absorbing heat from a stream of ambient air as it rises within the tubes and changing into a vapor phase. Momentum and gravity effects, due to the large mass differences between the liquid and gas phases of the refrigerant, can result in separation of the phases within the inlet manifold and cause poor refrigerant distribution throughout the core of the heat exchanger. Poor refrigerant distribution degrades evaporator performance and can result in uneven temperature distribution over the core.

Distributor tubes are known in the art to be used within inlet manifolds to aid in the even distribution of refrigerant through the core. Also, distributor tubes are known to be used in the outlet manifolds, the upper manifold in evaporative mode, to assist in the collection of refrigerant vapors to reduce the pressure drop through the core of the heat exchanger assemblies. A typical distributor tube includes a plurality of apertures axially spaced from one another for dispensing or receiving a refrigerant in a radial direction.

The distributor tube is held in position as it extends through the inlet manifold by a braze joint on either ends of the manifold.

Audible noises are created due to the unconstrained increased length of the distributor tube swaying or vibrating resulting in repeated contact with the inside wall of the manifolds of a modified automotive heat exchanger assembly. Excessive continuous vibrations of the distributor tube may create fatigue fractures to the wall of the manifolds or to the distributor tube itself, as well as damaging the ends of the refrigerant tubes from repeated impacts of the distributor tube to the refrigerant tube ends. There exists a need to reduce the excessive vibrations of the distributor tube to reduce or eliminate audible noise and to prevent damage to the heat exchanger assembly.

SUMMARY OF THE INVENTION

The invention provides for a heat exchanger assembly having a distributor tube retainer tab to hold and maintain a distributor tube in a predetermined position within a manifold of the heat exchanger assembly. The heat exchanger assembly includes a first manifold extending along a manifold axis $A_{manifold}$, in which the first manifold includes a manifold wall having an interior surface defining an interior chamber, an exterior surface opposite of the interior surface, and a retainer slot connecting the interior surface and the exterior surface. The retainer slot extends substantially transverse to the manifold axis $A_{manifold}$. A retainer tab inserted through the retainer slot. The retainer tab defines a tab opening configured to engage and maintain the distributor tube within a predetermined position within the interior chamber. The tab opening may include a boss extending toward the center of the tab opening to fixably engage the distributor tube. The boss may be formed of a vibration reducing material.

The retainer tab includes a first tab portion that is easily inserted into the retainer slot extending into the interior chamber and a second tab portion having shoulder surfaces contoured to seat onto a surface of the first manifold. The retainer tab may also include a third tab portion located between the first tab portion and the second tab portion, in which the third tab portion includes opposite facing end surfaces. The opposite facing end surfaces may be complementary to the corresponding width surfaces of the retainer slot. The retainer tab may be interference fitted into the retainer slot.

The retainer tab provides the advantages of reducing the excessive vibrations of the distributor tube to reduce audible noise and to prevent damage to the ends of the refrigerant tubes; not requiring a braze joint inside the manifold, which would be difficult or impossible to check, to permanently engage the distributor tube; holding the distributor tube in close contact with the inside wall of the header, thereby avoiding interference with the refrigerant tubes; and maintaining the distributor tube in the proper centered location, in applications where the manifold is bent, by restraining the distributor tube during the bending process.

BRIEF DESCRIPTION OF THE DRAWINGS

Shown in FIG. 1 is a perspective view of a heat exchanger assembly having the first and second manifolds spaced from the heat exchanger core.

Shown in FIG. 2 is a perspective cross-sectional view of the first manifold of FIG. 1 taken along line 2-2.

Figure 2:
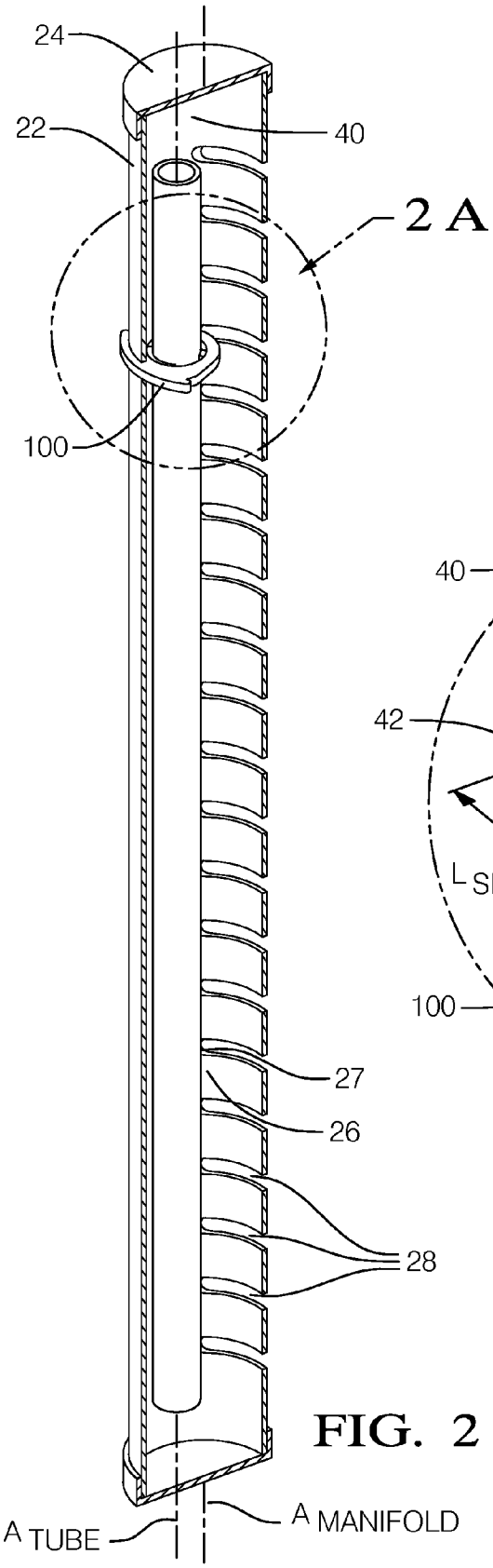
Figure 2A:
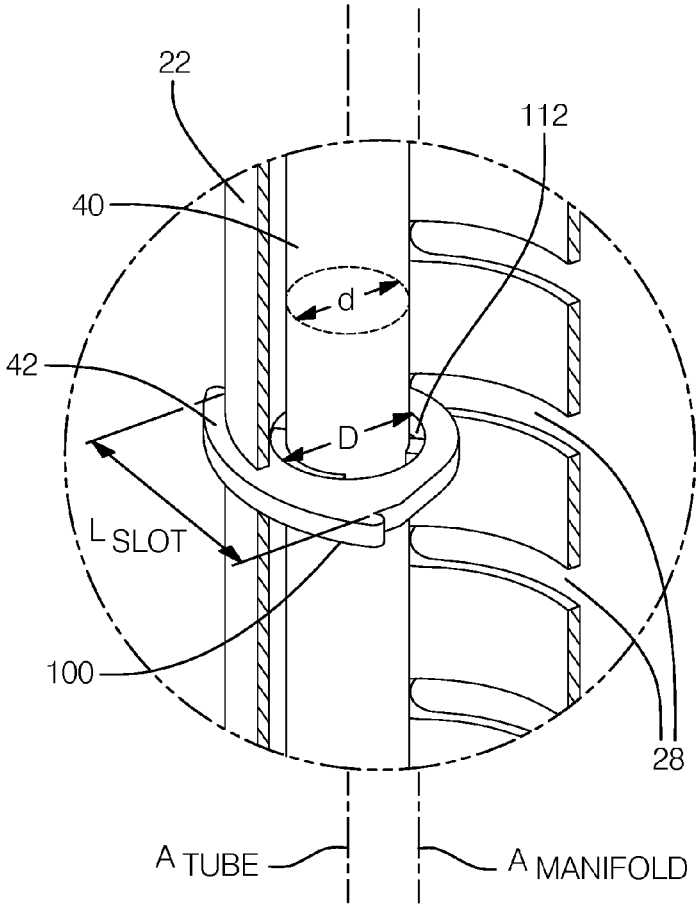

Shown in FIG. 2A is a detail perspective cross-sectional view of the first manifold of FIG. 2 showing a retainer tab maintaining a distributor tube in a predetermined position.

Figure 3:
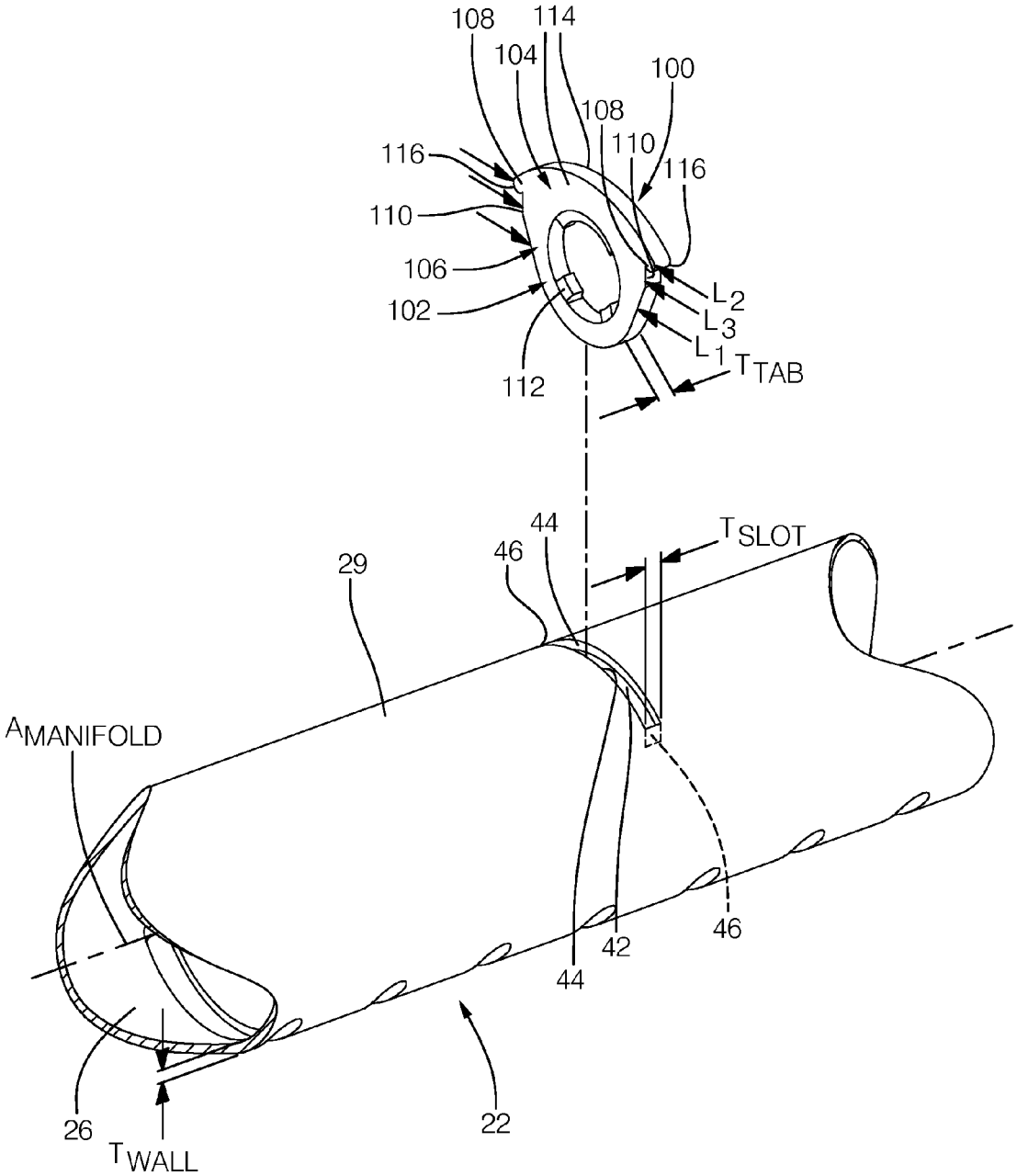

Shown in FIG. 3 is a perspective view of the retainer tab of FIG. 2A spaced apart from a retainer slot in the first manifold.

Figure 4:
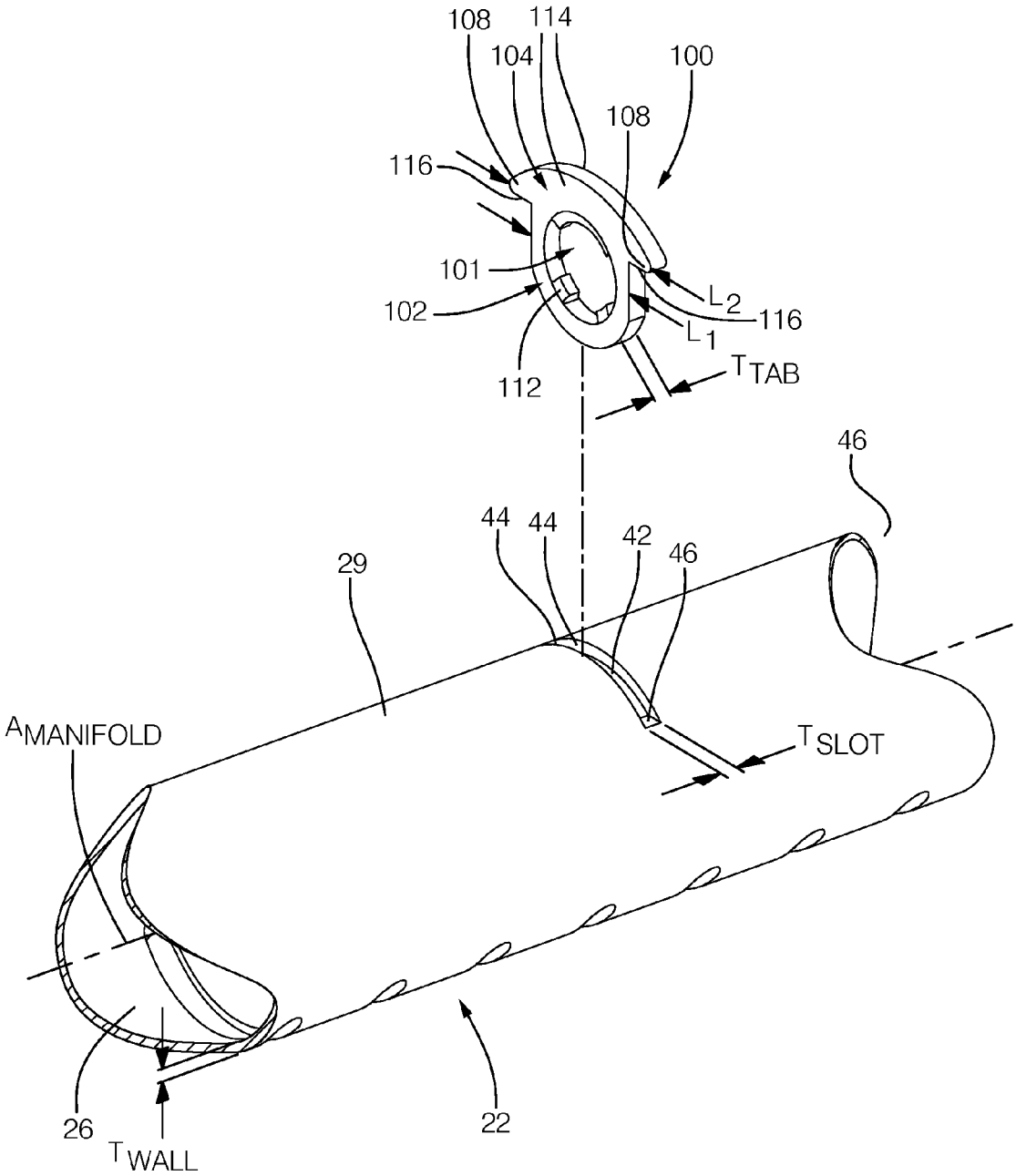

Shown in FIG. 4 is a perspective view of an alternative embodiment of a retainer tab spaced apart from a retainer slot in the first manifold.

DETAILED DESCRIPTION OF THE INVENTION

Referring to the Figures, wherein like numerals indicate corresponding parts throughout the several views, is an exemplary embodiment of a heat exchanger assembly 20 for transferring heat between a first fluid and a second fluid is generally shown. The first fluid of the exemplary embodiment may be that of a two phase refrigerant and the second fluid may be that of a stream of ambient air. It should be appreciated that other first and second fluids may be used.

Figure 1:
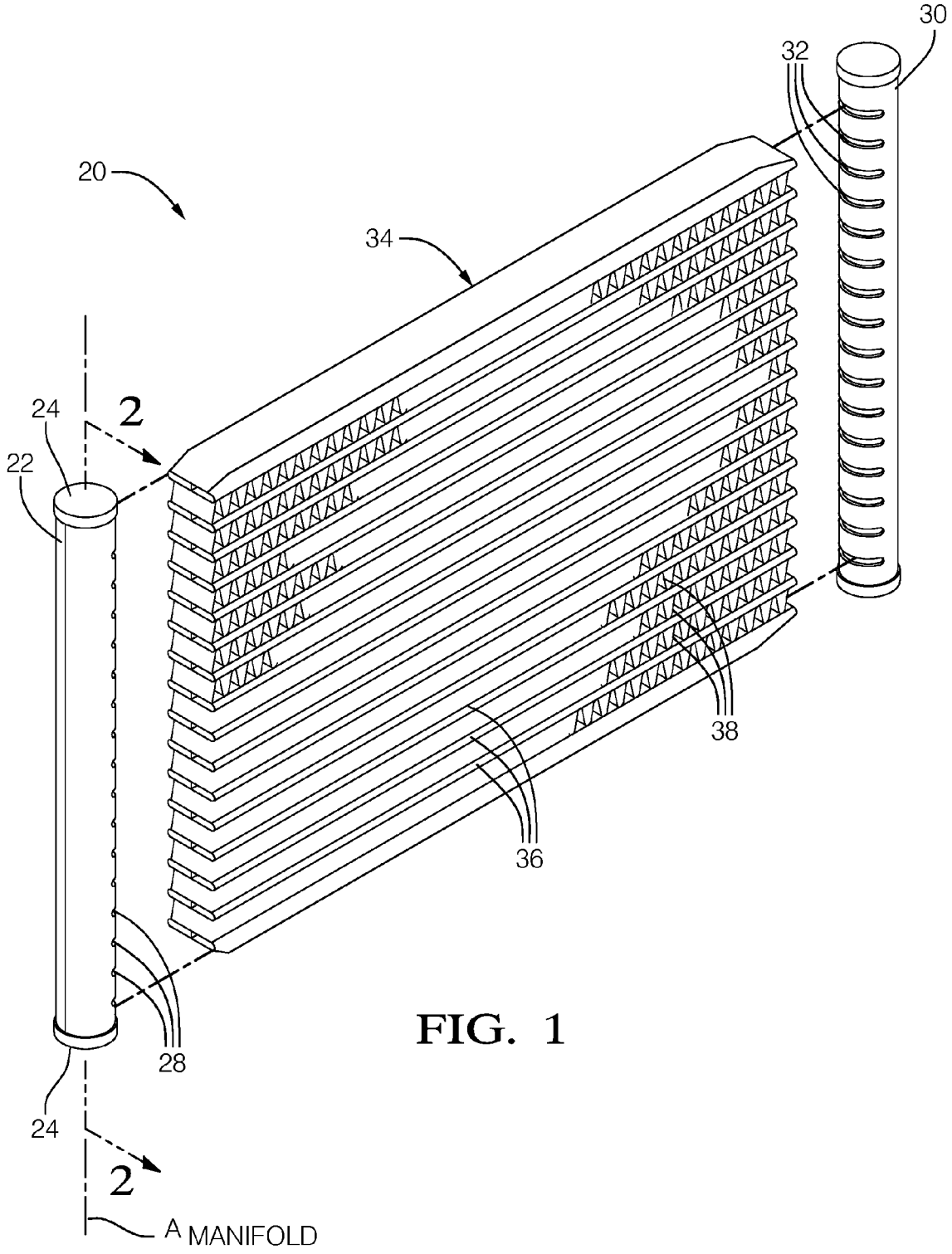

Shown in FIG. 1 is a heat exchanger assembly 20 having a first manifold 22 extending along a manifold axis $A_{manifold}$ between first manifold ends 24. The first manifold 22 has an interior surface 26 defining an interior chamber 27, which is best shown in FIG. 2. The first manifold 22 presents a plurality of first tube slots 28 spaced apart from one another along the axis $A_{manifold}$. The heat exchanger assembly 20 also includes a second manifold 30 extending in a spaced and substantially parallel relationship with the first manifold 22. The second manifold 30 presents a plurality of second tube slots 32 spaced apart from one another and aligned with the first tube slots 28 of the first manifold 22. The first and second manifolds 22, 30 are shown in the vertical orientation with respect to gravity as an illustrative example and it is not meant to be limited as such. The first and second manifolds 22, 30 may be tilted from the horizontal direction to the vertical direction with respect to the direction of gravity.

A heat exchanger core 34 is disposed between the first and second manifolds 22, and includes a plurality of fluid tubes 36 extending into the corresponding first and second tube slots 28, 32 for conveying a fluid, such as a two phase refrigerant, from the first manifold 22 to the second manifold 30. The heat exchanger core 34 further includes a plurality of air fins 38 disposed between the fluid tubes 36 for transferring heat between the refrigerant in the tubes 36 and a stream of ambient air. While the heat exchanger core 34 shown has substantially straight fluid tubes 36, the fluid tubes 36 may be bent in any configuration to accommodate for the packaging requirements of the heat exchanger assembly 20 within a given space or for optimizing the drainage of condensate from the heat exchanger core 34.

Referring to FIG. 2 is cross sectional view of the first manifold 22 of the heat exchanger assembly 20 of FIG. 1. A distributor tube 40 is disposed in the interior chamber 27 of the first manifold 22, in which the distributor tube 40 extends along a distributor tube axis $A_{tube}$. Maintaining the distributor tube 40 in a predetermined position within the interior chamber 27 of the first manifold 22 apart from the ends of the fluid tubes 36 is a distributor tube retainer tab 100. Shown in FIG. 2A, the retainer tab 100 is configured to be inserted through an elongated retainer slot 42 defined through the wall 23 of first manifold 22, in which the length ($L_{slot}$) of the retainer slot 42 extends substantially transverse to the axis $A_{manifold}$. Shown in FIGS. 3 and 4, the retainer slot 42 of the first manifold 22 includes a pair of length surfaces 44 and a pair of width surfaces 46 defined in the wall 23 between the interior surface 26 and exterior surface 29 of the first manifold 22.

Referring to FIGS. 2A, 3 and 4, is a retainer tab 100 configured to restrain the distributor tube 40 to prevent undesirable audible noises as noticed on unrestrained distributor tubes when subjected to vibrations or handling. The retainer tab 100 defines a tab opening 101, through which the distributor tube 40 is inserted. The tab opening 101 may be that of a generally rounded shape or that of a shape complementary to that of the external cross section shape of the distributor tube 40. The tab opening 101 may include a diameter (D) sized to provide an interference fit between the retainer tab 100 and the distributor tube 40 inserted through the tab opening 101. In the alternative, the diameter (D) of the tab opening 101 may be slightly larger than the external diameter (d) of the distributor tube 40 and may include at least one boss 112 extending radially toward the center of the tab opening 101. The boss 112 is sized to grip onto the distributor tube 40 to fixably engage and maintain the distributor tube 40 onto the retainer tab 100.

The retainer tab 100 includes a thickness ($T_{tab}$) separating a pair of tab surfaces 114, which are oriented in opposite directions. The thickness ($T_{tab}$) of the retainer tab 100 is substantially that of the thickness ($T_{slot}$) of the retainer slot 42 defined by the distance between the opposing length surfaces 44, such that the tab surfaces 114 are interference fitted against the length surfaces 44 once the retainer tab 100 is inserted into position within the retainer slot 42. The thickness ($T_{slot}$) of the retainer slot 42 and corresponding thickness ($T_{tab}$) of the retainer tab 100 may not need to be any thicker than the thickness ($T_{wall}$) of the wall 23, the distance between the interior surface 26 and exterior surface 29 of the first manifold 22.

The retainer tab 100 includes a first tab portion 102 having a length ($L_1$) across each of the tab surfaces 114 that is less than the length ($L_{slot}$) of the retainer slot 42 such that the first tab portion 102 is easily inserted into the retainer slot 42. The retainer tab 100 further includes a second tab portion 104 having a length ($L_2$) across each of the tab surfaces 114 that is greater than the length ($L_{slot}$) of the retainer slot 42 and defines opposite facing shoulder portions 108. Each of the shoulder portions 108 includes a shoulder surface 116 contoured to seat onto the exterior surface 29 of the first manifold 22, as shown in FIG. 3, or seat onto the width surface 46 of the retainer slot 42, as shown in FIG. 4, once the retainer tab 100 is inserted into the retainer slot 42 and engaged to the first manifold 22.

For a retainer slot 42 having a pair of substantially opposing width surfaces 46 as shown in FIG. 3, the retainer tab 100 may also include a third tab portion 106 located between the first tab portion 102 and second tab portion 104, in which the third tab portion 106 includes opposite facing end surfaces 110. The opposite facing end surfaces 110 are complementary to the corresponding width surfaces 46 of the retainer slot 42. The length ($L_3$) across each of the tab surfaces 114 between the end surfaces 110 is substantially the same as that of the length ($L_{slot}$) of the retainer slot 42, thereby allowing the third tab portion 106 to be inserted in the retainer slot 42 such that the end surfaces 110 of the retainer tab 100 are interference fitted against the width surfaces 46 of the retainer slot 42.

The retainer tab 100 may be stamped as a single component from a single or double sided clad aluminum braze sheet, or in the alternative, may be form from non-clad braze sheet for applications where sufficient cladding is available on the first manifold wall 23. In manufacturing the heat exchanger assembly 20, the retainer tab 100 may be inserted into a preformed retainer slot 42 through the wall 23 of the first manifold 22. The distributor tube 40 may then be threaded through the tab opening 101 in the retainer tab 100 using a fixture that contains guides to ensure proper assembly. The distributor tube 40, when properly guided by the fixture, reduces the probability of missing the tab opening 101. The boss 112 may comprise the same material as that of the retainer tab 100 such as aluminum.

Multiple retainer tabs 100 may be placed in multiple locations along the length of the first manifold 22, to allow better restraint of distributor tubes having excessive lengths, and to keep the distributor tubes centered in the manifolds for applications that require bending of the manifold. The design of the retainer tab 100 ensures no contact or interference with the fluid tubes due to the retainer tab's mounting surface being on the opposite side of the manifold from where the fluid tubes enter the manifold. Once the retainer tabs 100, distributor tube 40, and manifold 22 are assembled together, there is minimal probability of the components coming apart due to handling, shaking, or vibration before the braze operation.

The use of the retainer tab 100 provides the advantage of it being used in multiple locations along the length of the manifold for applications where the length of the distributor tube is too long to be only constrained on the ends. The retainer tab 100 also provides the advantage tightly gripping the distributor tube, therefore not requiring a braze joint inside the manifold, which would be difficult or impossible to check after the heat exchanger assembly is brazed. The retainer tab 100 further provides the advantage or holding the distributor tube in close contact with the inside wall of the manifold, thereby avoiding interference with the fluid tubes. Still furthermore, the retainer tab 100 provides the advantage of maintaining the distributor tube 40 in the proper centered location, in applications where the manifold is bent, by restraining the distributor tube during the bending process.

It should be appreciated that the heat exchanger assembly 20 can be used as an evaporator, a condenser, or any other type of heat exchanger construction. Additionally, although the heat exchanger assembly 20 of the exemplary embodiment is shown as a one-pass heat exchanger, the fluid distributor tube 40 can also be used in a multi-pass heat exchanger assembly 20. Furthermore, the fluid tubes forming the core of the heat exchanger assembly and the manifolds, together or separately, may be bent to accommodate packaging or condensate drainage requirements. While this invention has been described in terms of the preferred embodiments thereof, it is not intended to be so limited, but rather only to the extent set forth in the claims that follow.

Having described the invention, it is claimed:

1. A heat exchanger assembly comprising:

a tubular manifold formed in one piece and extending along a manifold axis, the tubular manifold includes a one piece manifold wall having an interior surface defining an interior chamber and an exterior surface opposite of the interior surface, wherein the manifold wall defines a retainer slot connecting the interior surface and the exterior surface, and wherein the retainer slot is diametrically opposed to a series of tube slots in the one piece manifold wall;

a distributor tube disposed in the interior chamber; and a retainer tab inserted through the retainer slot, a portion of the retainer tab extending within the manifold short of the tube slots and defining a tab opening configured to engage and maintain the distributor tube within a predetermined position within the interior chamber.

2. The heat exchanger assembly of claim 1, wherein the tab has two opposing surfaces perpendicular to the manifold axis, the opposing surfaces defining a tab thickness, the tab thickness of at least the portion extending within the manifold being dimensioned substantially equal to a width of the retainer slot along the manifold axis.

3. A heat exchanger assembly comprising:

a tubular manifold formed in one piece and extending along a manifold axis, the tubular manifold includes a one piece manifold wall having an interior surface defining an interior chamber and an exterior surface opposite of the interior surface, wherein the manifold wall defines a retainer slot connecting the interior surface and the exterior surface, and wherein the retainer slot is diametrically opposed to a series of tube slots in the one piece manifold wall;

a distributor tube disposed in the interior chamber; and a retainer tab inserted through the retainer slot, a portion of the retainer tab extending within the manifold short of the tube slots and defining a tab opening configured to engage and maintain the distributor tube within a predetermined position within the interior chamber;

wherein the distributor tube includes a distributor tube outer diameter (d);

wherein the tab opening of the retainer tab includes a tab opening diameter (D) greater than the distributor tube outer diameter (d);

wherein the retainer tab includes at least one boss extending radially into the tab opening toward the distributor tube, such that the at least one boss fixably engages the distributor tube.

4. The heat exchanger assembly of claim 3, wherein the at least one boss comprises aluminum.

5. The heat exchanger assembly of claim 3, wherein the retainer slot extends substantially transverse to the manifold axis and includes a pair of opposing length surfaces and a pair of width surfaces;

wherein the retainer tab further includes a first tab portion inserted into the interior chamber through the retainer slot and a second tab portion having opposite facing shoulder portions; and wherein each of the shoulder portions includes a shoulder surface contoured to engage a surface of the tubular manifold, thereby seating the retainer tab in the retainer slot.

6. The heat exchanger assembly of claim 5, wherein the pair of width surfaces are oriented in the same direction; and wherein each of the shoulder surface engages respective the width surfaces of the retainer slot.

7. The heat exchanger assembly of claim 5;

wherein the pair of width surfaces are oriented in a substantially opposing direction;

wherein the retainer tab further includes a third tab portion positioned between the first tab portion and the second tab portion, the third tab portion includes a pair of substantially opposite facing end surfaces complementary to corresponding the pair of width surfaces;

wherein the opposite facing end surfaces engage the width surfaces; and wherein the shoulder surfaces seat on to the exterior surface of the tubular manifold.

8. A heat exchanger assembly comprising:

a tubular manifold formed in one piece and extending along a manifold axis, the tubular manifold includes a one piece manifold wall defining an interior chamber with an interior diameter and a retainer slot through the one piece manifold wall substantially transverse to the manifold axis;

a distributor tube having a distributor tube outer diameter (d) and disposed in the interior chamber; and a retainer tab inserted through the retainer slot in an insertion direction, the retainer tab engages and maintains the distributor tube within a predetermined position within the interior chamber, wherein the retainer tab has an insertion depth in the insertion direction that is smaller than the interior diameter of the interior chamber in the insertion direction, and a tab opening that includes a tab opening diameter (D) greater than the distributor tube outer diameter (d); wherein the retainer tab includes at least one boss extending radially into the tab opening toward the distributor tube, such that the at least one boss fixably engages the distributor tube.

9. The heat exchanger assembly of claim 8, wherein the retainer tab includes a first tab portion disposed within the interior chamber, the first tab portion defines a tab opening configured to engage and maintain the distributor tube in a predetermined location within the interior chamber.

10. The heat exchanger assembly of claim 9, wherein the retainer tab further includes a second tab portion engaged onto the exterior surface of the tubular manifold.

11. The heat exchanger assembly of claim 10, wherein the retainer tab further includes a third tab portion located between the first tab portion and second tab portion, the third tab portion includes a pair of opposite facing end surfaces engaging the wall of the tubular manifold.

12. The heat exchanger assembly of claim 10, wherein the retainer tab is interference fitted into the retainer slot against the wall of the tubular manifold.

* * * * *